US007226313B2

(12) United States Patent
Shamoto et al.

(10) Patent No.: US 7,226,313 B2
(45) Date of Patent: Jun. 5, 2007

(54) CONNECTOR HAVING SLITS FOR GUIDING TERMINAL FITTINGS AND LOCKING RETAINER

(75) Inventors: Wataru Shamoto, Yokkaichi (JP); Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/353,375

(22) Filed: Feb. 13, 2006

(65) Prior Publication Data

US 2006/0183376 A1 Aug. 17, 2006

(30) Foreign Application Priority Data

Feb. 17, 2005 (JP) ..... 2005-040625

(51) Int. Cl.
*H01R 13/40* (2006.01)

(52) U.S. Cl. ..... 439/595; 439/752.5

(58) Field of Classification Search ..... 439/595, 439/744, 752, 752.5
See application file for complete search history.

(56) References Cited

U.S. PATENT DOCUMENTS 5,205,763 A * 4/1993 Watanabe et al. ..... 439/752
5,209,676 A * 5/1993 Endo et al. ..... 439/595
5,607,327 A * 3/1997 Tsuji et al. ..... 439/752
5,820,417 A * 10/1998 Yamada ..... 439/686
5,989,066 A * 11/1999 Cox ..... 439/595
6,109,965 A * 8/2000 Seko et al. ..... 439/595
7,114,992 B2 * 10/2006 Sagawa et al. ..... 439/595
7,114,997 B2 * 10/2006 Sagawa et al. ..... 439/752

FOREIGN PATENT DOCUMENTS

JP 2003-123890 4/2003

* cited by examiner

*Primary Examiner*—Thanh-Tam Le
(74) *Attorney, Agent, or Firm*—Gerald E. Hespos; Anthony J. Casella

(57) ABSTRACT

A connector has a housing (10) with cavities (13) for receiving terminal fittings (20) and a front retainer (30) that can be mounted on a front surface of the housing (10). A short projection (24) and a long projection (37) are formed at a front end of a guide (18) that receives a stabilizer (21) of the terminal fitting (20). Locking projections (35, 36) are formed on the front retainer (30) and can be locked respectively to the short and long projections (24, 37). Thus, the connector has a simple construction and is compact. The housing (10) also has a lance (22) that can be locked to the terminal fitting (20). The lance (22) constitutes part of an outer surface of the housing (10). Thus, the connector can be even smaller.

14 Claims, 13 Drawing Sheets

CONNECTOR HAVING SLITS FOR GUIDING TERMINAL FITTINGS AND LOCKING RETAINER

BACKGROUND OF THE INVENTION

1. Field of the Invention

The present invention relates to a connector.

2. Description of the Related Art

Japanese Patent Application Laid-Open No. 2003-123890 discloses a connector with a housing formed with a cavity for receiving a terminal fitting. A lance is formed in the housing and projects sufficiently into the cavity to lock the terminal fitting therein. However, the lance can deflect into a flexible space in the housing so that the terminal fitting can be inserted into the cavity or removed from the cavity.

A retainer is mounted to the front end of the housing and is movable between a temporary locking position and a main locking position. The retainer is outside the flexible space of the lance when the retainer is at the temporary locking position. Thus, the terminal fitting can be inserted into the cavity and removed from the cavity when the retainer is at the temporary locking position. However, the retainer enters the flexible space of the lance and prevents the lance from deflecting when the retainer is at the main locking position.

A temporary locking groove and a main locking groove extend transversely into a front part of the housing. A temporary locking projection and a main locking projection are formed on an inner surface of the retainer at positions spaced longitudinally from one another. The temporary locking projection engages the front end of the temporary locking groove when the retainer is at the temporary locking position. Conversely, the main locking projection engages the front end of the main locking groove when the retainer is at the main locking position.

A guide groove extends longitudinally in the cavity for guiding a stabilizer of the terminal fitting. The need for a longitudinally extending guide groove and transversely extending locking grooves results in a complicated construction.

The invention was made in view of the above-described situation, and it is an object of the invention to provide a connector with a simple construction.

SUMMARY OF THE INVENTION

The invention relates to a connector with a housing that has opposite front and rear ends. Cavities extend longitudinally through the housing from the rear end to the front end, and terminal fittings are inserted respectively into the cavities. Each terminal fitting has a stabilizer projecting therefrom. Guides are formed in the housing and guide the stabilizers when the terminal fittings are inserted into the cavities. The connector further includes a mounting member mounted on the front of the housing. The mounting member is locked to the guides for the stabilizers.

The above-described conventional connector housing has guides for the stabilizer formed separately from the locking grooves for the retainer. Thus the conventional housing has a complicated construction. However, the connector of the subject invention is configured to lock the mounting member to the guide for the stabilizer. Therefore the connector of the present invention has a simple construction.

Each guide preferably is a groove formed on the exterior of the housing. Each guide groove extends longitudinally along an insertion direction of the terminal fittings, and at least a portion of each guide groove communicates with the inside of the cavity. Thus, the stabilizer moves along the guide groove of the housing as the terminal fitting is inserted into the cavity.

At least one locking edge preferably is formed at a front end of each guide groove and intersects the respective guide groove at an angle to the longitudinal direction of the guide groove. The mounting member is formed with at least one lock that engages the locking edge to prevent the mounting member from slipping off the housing.

The housing preferably has resiliently deformable lances that can project into the cavities for locking the terminal fittings in the cavities. Each lance preferably has an outer surface that defines part of an outer surface of the housing. Therefore the connector has a simpler construction than the conventional connector in which the outer surfaces of the lance and the housing are formed separately.

The mounting member preferably is a front retainer formed in the shape of a cap and configured for mounting on the front of the housing. The front retainer penetrates into a flexible region of each lance and prevents each lance from deforming out of locked engagement with the terminal fitting.

The lances can deform elastically to project out from the outer surface housing. A deformed lance can prevent proper mounting of the front retainer.

The at least one locking edge of the guide groove preferably includes a temporary locking edge and a main locking edge that are spaced apart in the longitudinal direction of the housing. The at least one locking projection preferably includes a temporary locking projection and a main locking projection formed on the front retainer at positions corresponding to the guide grooves. The temporary locking projection is shifted from the main locking projection in a longitudinal direction of the front retainer. The temporary locking projection can be locked to the temporary locking edge to hold the front retainer in a position that permits elastic deformation of the lances so that the terminal fittings can be inserted into the respective cavities and removed therefrom. However, the front retainer can be moved to a position on the housing where the main locking projection locks to the main locking edge. Part of the front retainer penetrates into the flexible region of the lance and prevents the lance from deforming when the main locking projection engages the main locking edge. The connectors can be shipped from a manufacturing location to an assembly location with the front retainers in the temporary locked position on the respective housings. The front retainers then can be moved to the main locking position after the terminal fittings have been inserted into the cavities. Therefore, assembly efficiency and inventory control are improved.

DETAILED DESCRIPTION OF THE PREFERRED EMBODIMENTS

Figure 1:
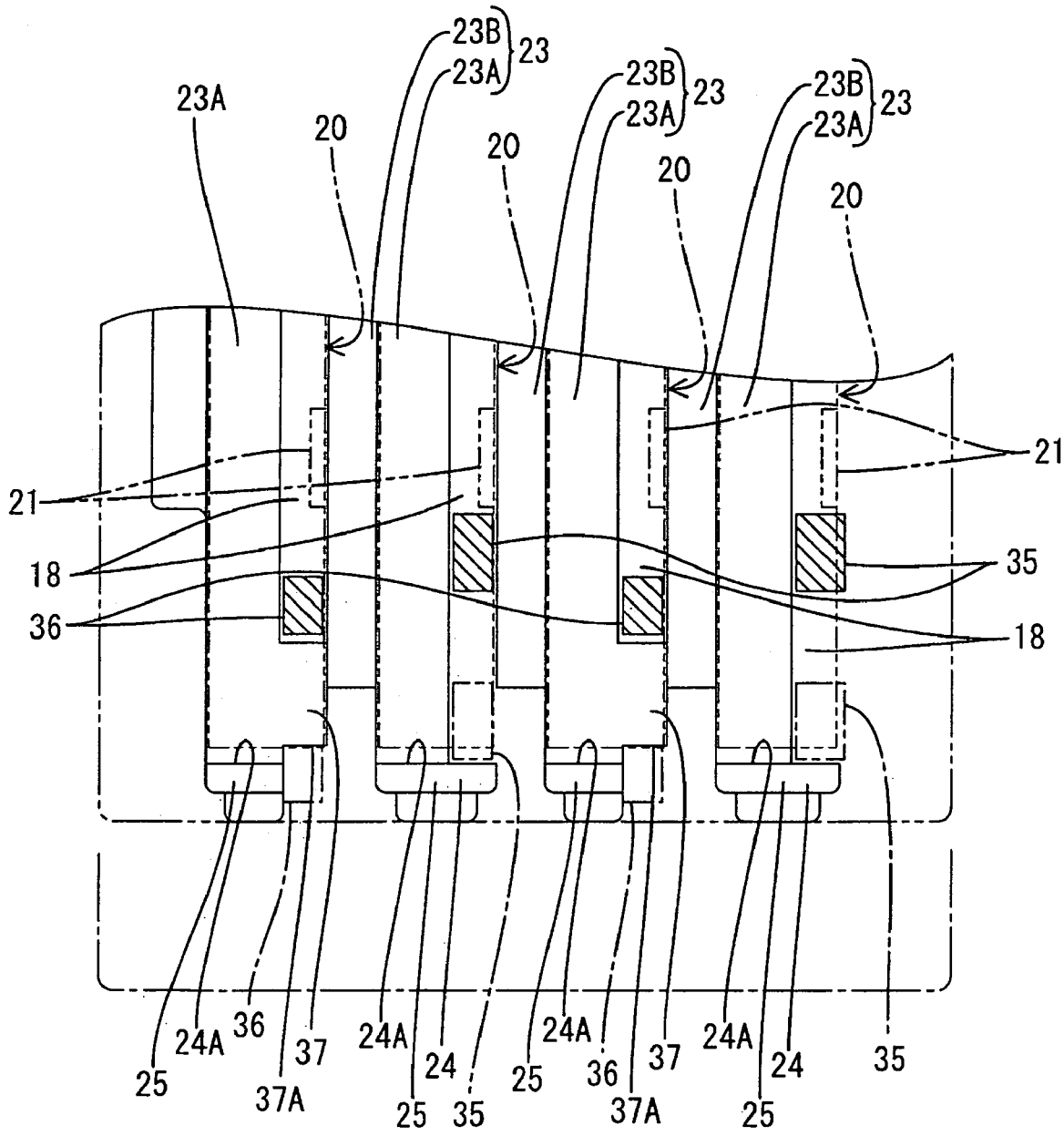
FIG. 1 is a main portion-enlarged plan view showing a state in which a connector and a front retainer are locked to each other at a temporary locking position and a main locking position in a first embodiment.
Figure 2:
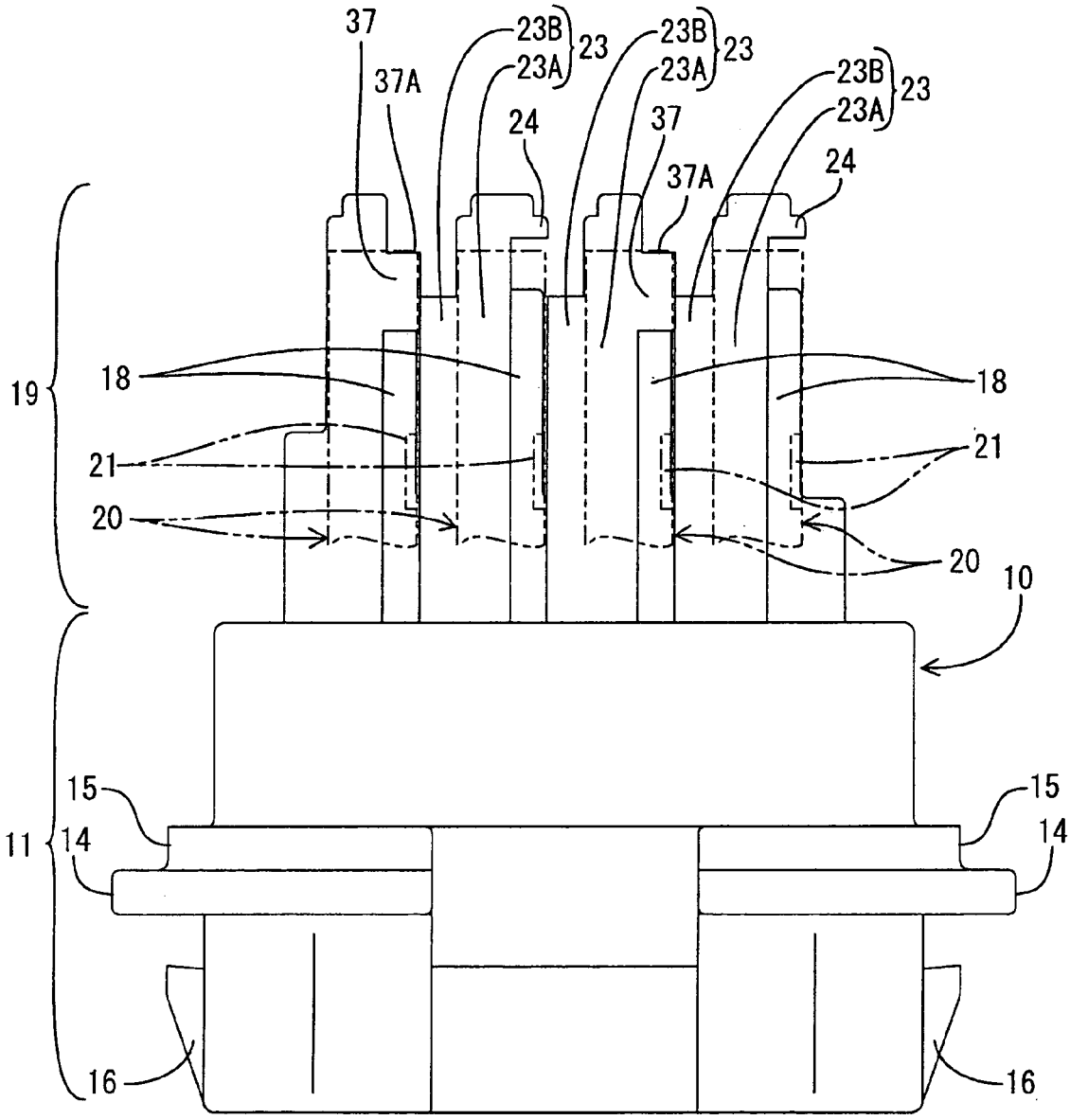
FIG. 2 is a bottom view showing a connector housing.

A connector in accordance with the invention includes a housing identified by the numeral 10 in FIGS. 1 to 14. The housing 10 has opposite front and rear ends, as shown respectively at the right and left sides of FIG. 11, and cavities 13 extend longitudinally through the housing 10 from the rear end to the front end. The cavities are arranged substantially side-by-side, as shown in FIG. 5. Each cavity 13 is configured to receive a terminal fitting 20 having a stabilizer 21 projecting therefrom. The connector further includes a front retainer 30 with a rear end that can be mounted on the front end of the housing 10, as shown most clearly in FIG. 11. The term vertical is used herein as a frame of reference and identifies the orientation shown in FIGS. 5 and 8.

Figure 11:
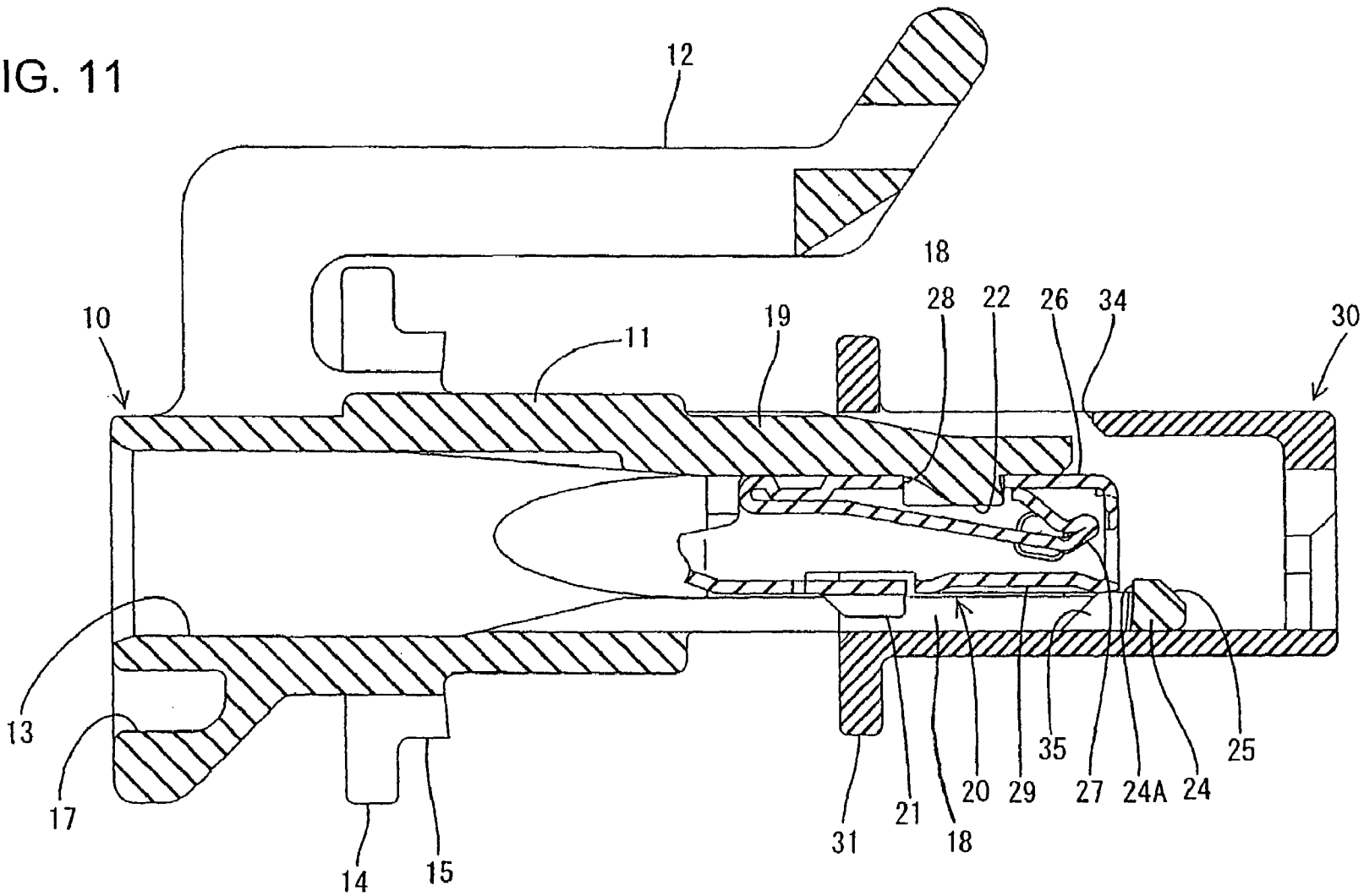
FIG. 11 is a sectional view showing a locked state of a temporary locking projection when the front retainer is located at a temporary locking position.
Figure 12:
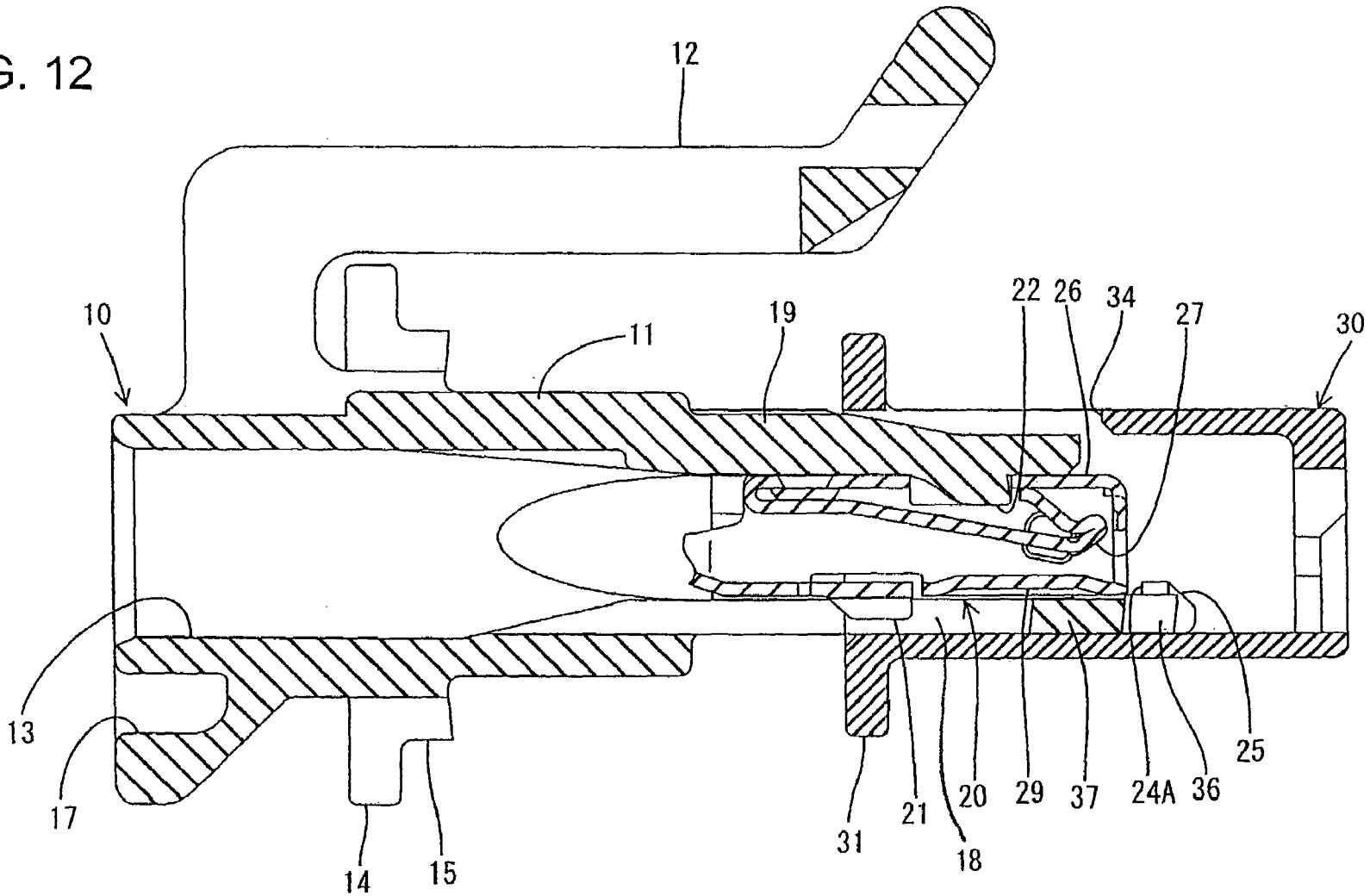
FIG. 12 is a sectional view showing a locked state of a main locking projection when the front retainer is located at the temporary locking position.
Figure 13:
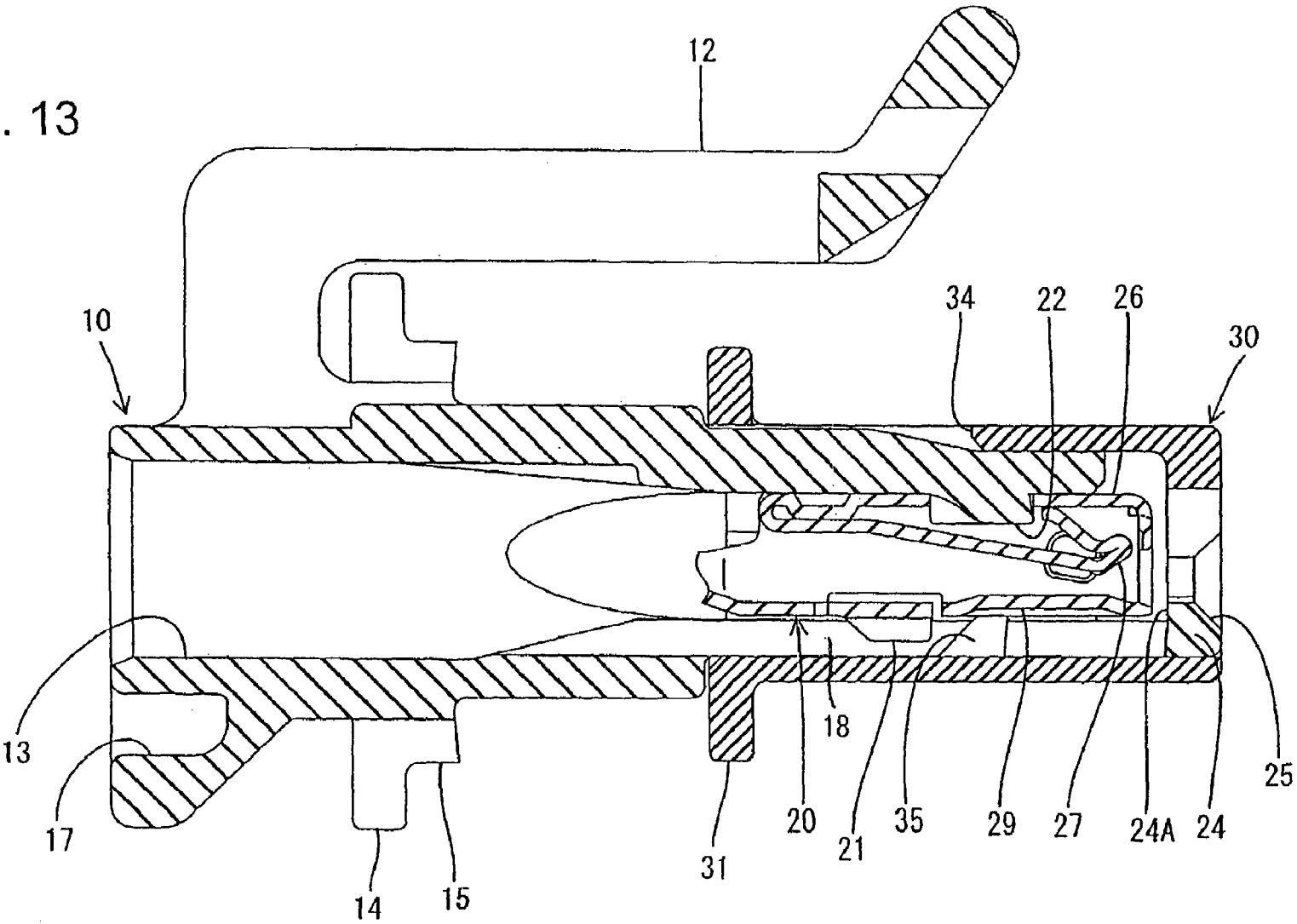
FIG. 13 is a sectional view showing a locked state of the temporary locking projection when the front retainer is located at a main locking position.
Figure 14:
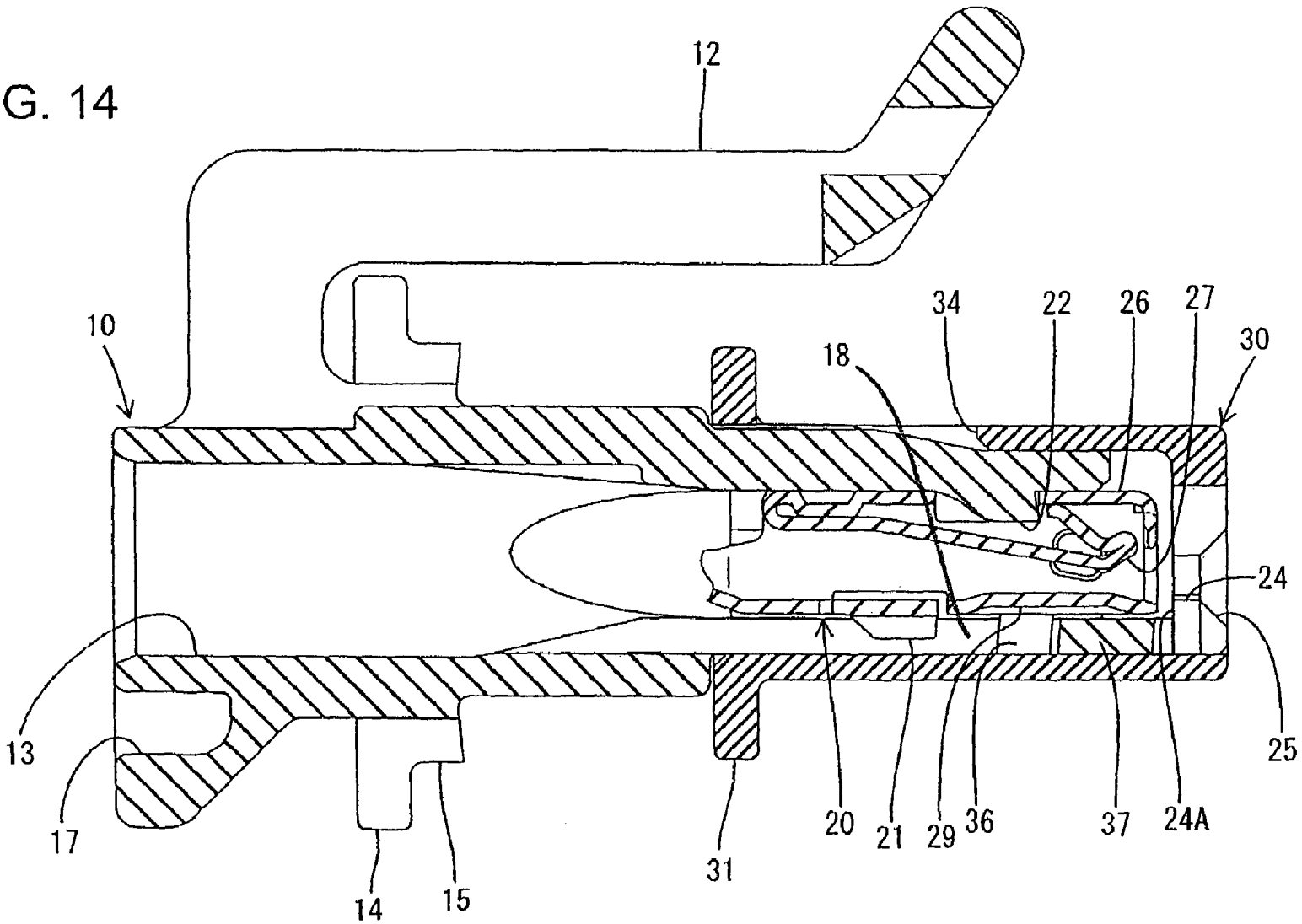
FIG. 14 is a sectional view showing a locked state of the main locking projection when the front retainer is located at the main locking position.

As shown in FIG. 11, each terminal fitting 20 has a square tubular portion 26. A flexible elastic contact 27 extends in from an upper panel of the square tubular portion 26, and a contact projection 29 is formed by inwardly striking a bottom panel of the square tubular portion 26 at a location substantially opposite a front part of the square tubular portion 26. A male tab (not shown) can be sandwiched elastically between the contact projection 29 and the elastic contact 27 to achieve electrical connection between the male tab and the terminal fitting 20. A lance hole 28 is formed at approximately the center of the upper surface of the square tubular portion 26. A stabilizer 21 is formed by cutting the bottom panel of the square tubular portion 26 at a position rearward from the contact projection 29 and bending the cut portion out and down at a substantially right angle. The stabilizer 21 is long in a longitudinal direction of the housing 10 and flush with the right side panel of the square tubular portion 26.

Figure 8:
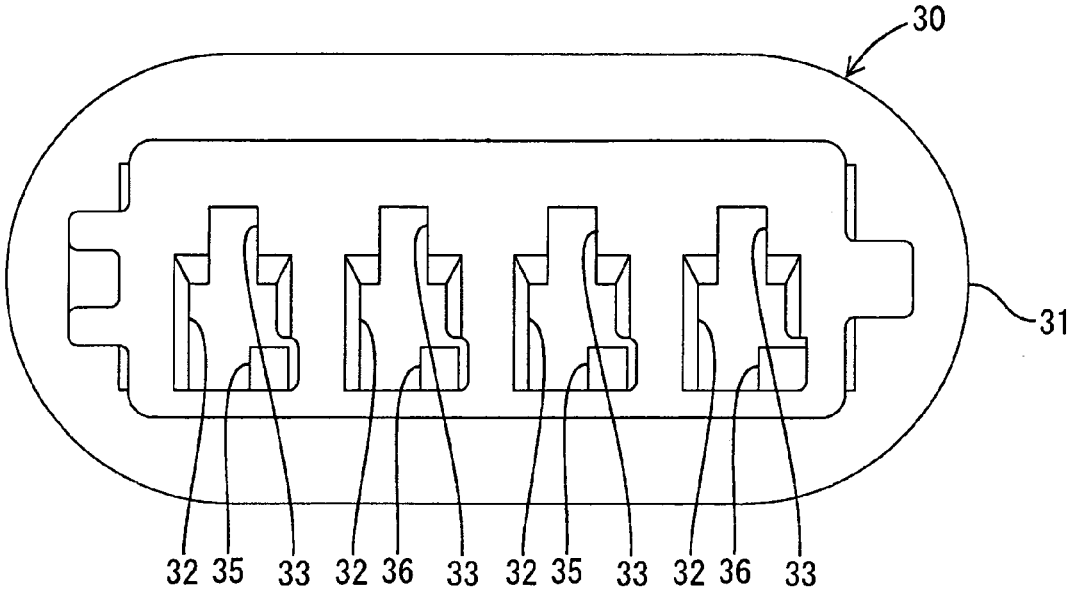
FIG. 8 is a front view showing the front retainer.

The housing 10 is made of synthetic resin. As shown in FIG. 11, a body 11 is formed at the rear end of the housing 11, and a vertically flexible locking arm 12 is cantilevered forward from a position on an upper surface of the body 11 near the rear end of the housing 11. As shown in FIG. 8, four cavities 13 extend longitudinally through the housing 10 and are arranged at equal intervals in the right-to-left direction.

A flange 14 projects out from an approximately longitudinal central portion of the body 11. However, the flange 14 is discontinuous on the upper surface of the body 11 to accommodate deflection of the locking arm 12. The flange 14 also is discontinuous on the bottom surface of the body 11 at a position substantially opposite to the locking arm 12 and aligned with a receiving portion 17. A step 15 projects from the bottom surface of the body 11 at a position forward from the flange 14. Housing-fixing portions 16 project from the left and right side surfaces of the housing 10 at approximately the rear end of the body 11. The housing 10 can be fixed to a panel or wall (not shown) by sandwiching edge regions of the panel between the housing-fixing portion 16 and the flange 14. A front part of the body 11 is block-shaped and oblong in section, and a waterproof rubber plug (not shown) can be fit on an outer surface of the front part of the body 11.

A terminal locking portion 19 extends forward from the body 11 to the front end of the housing 10. The cavities 13 for accommodating the terminal fittings 20 are partitioned from each other. However, portions of the left and right cavities 13 in the terminal-locking portion 19 do not have an outer side wall. Thus square tubular portions 26 of the terminal fittings 20 are exposed in the cavities 13 at the left and right sides in the terminal-locking portion 19. Portions of each cavity 13 in the terminal-locking portion 19 have a lance 22 and a support 23 opposite the lance 22.

Each lance 22 extends forward from a front end of the upper wall of the body 11. A slit is formed between the adjacent lances 22 so that the lances 22 are independently vertically flexible. A locking claw 22A is formed at the front of each lance 22 (see FIG. 7) and can be locked to the lance hole 28 when the terminal fitting 20 is inserted to a predetermined normal position in the cavity 13.

Figure 3:
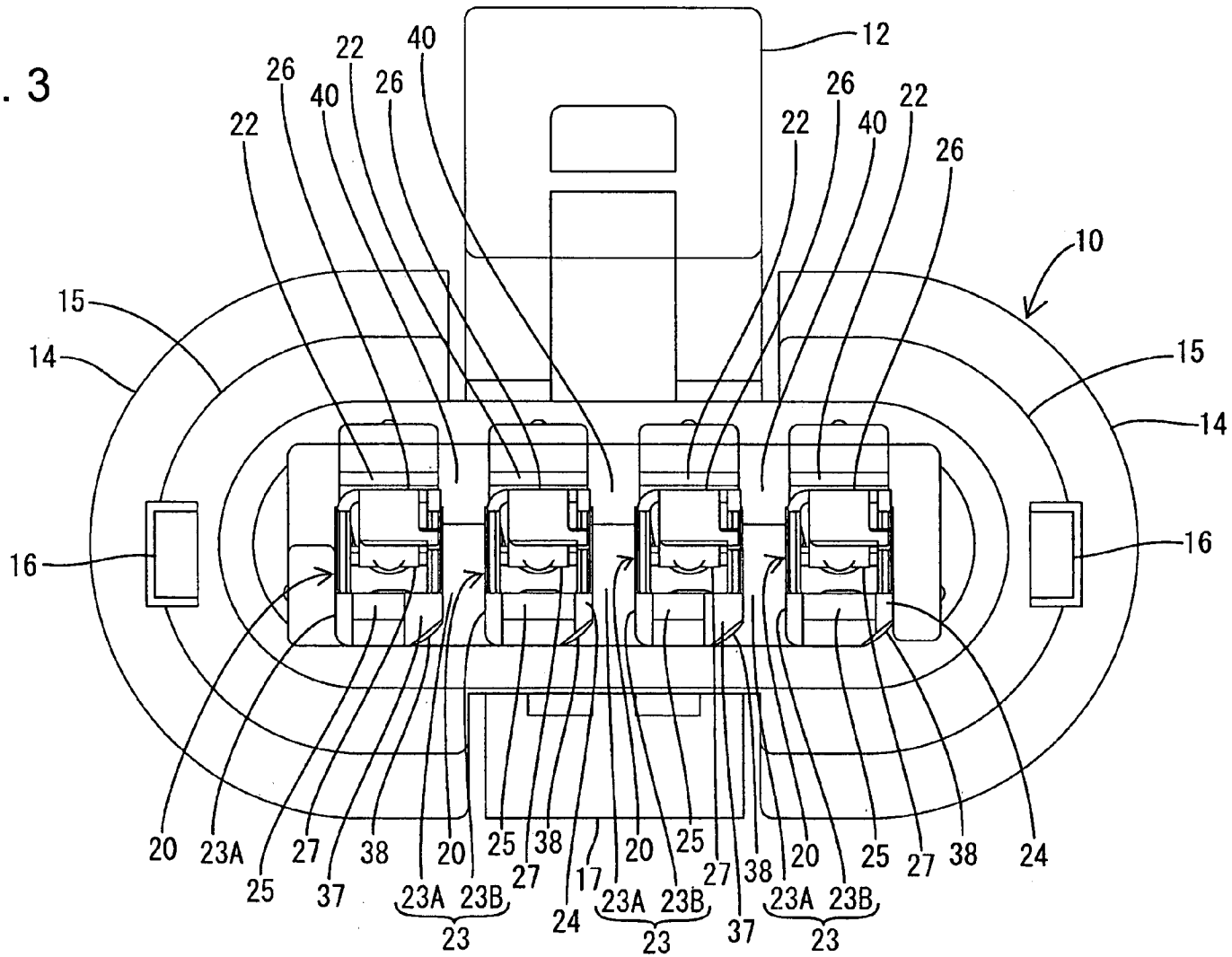
FIG. 3 is a front view showing the front retainer in a state before the front retainer is mounted on the connector housing.

Each support 23 extends forward from a front end of the body 11. The front end of the support 23 is disposed forward from the lance 22. Each support 23 has a supporting wall 23A for supporting the bottom surface of the square tubular portion 26 of the terminal fitting 20. Additionally, each support 23, except for the left end support 23 in FIG. 3, has a partitioning wall 23B. The portioning walls 23B project up from one side of the supporting wall 23A and extend in the longitudinal direction of the support 23 to partition the adjacent cavities 13 from each other. Thus, the supports 23 that have a partitioning wall 23B are substantially L-shaped when viewed from the front. The left-end support 23 in FIG. 3 does not have the partitioning wall 23B, but does have the support 23A. A rear end of each of the partitioning walls 23B is connected with the front end of the body 11, as shown in FIG. 3. Thus, it is difficult for the supports 23 that have the partitioning wall 23B to flex vertically despite the cantilevered construction, and only the lance 22 deforms when the terminal fitting 20 is inserted into the cavity 13.

As shown in FIG. 1, a guide slit 18 is provided in each gap between the adjacent supporting walls 23A in the longitudinal direction of the housing 10. Each guide slit 18 receives the stabilizer 21 when the terminal fitting 20 is inserted into the cavity 13 and guides the movement of the terminal fitting 20. The guide slits 18 also play a role in the movement of the front retainer 30, as described below.

Either a long projection 37 or a short projection 24 projects transversely from the front end of each supporting wall 23A. In the illustrated embodiment, the long and short projections 37, 24 define an alternating array, starting with a long projection 37 at the left-end position in FIG. 1. A pressing prevention surface 37A is defined at the front end of the long projection 37 and is stepped slightly rearward from the front end of the supporting wall 23A. A stop 24A is erected from an upper surface of the front end of each supporting wall 23A. The stops 24A are at positions forward from the pressing prevention surfaces 37A. Each stop 24A stops the corresponding terminal fitting 20 at a predetermined front position when the front end of the square tubular portion 26 of the terminal fitting 20 strikes the stop 24A. The short projections 24 project from the supporting walls 23A adjacent to the supporting walls 23A that have the long projections 37. More particularly, each short projection 24 is formed by projecting the stop 24A in a direction in which the stop 24A intersects the guide slit 18.

As shown in FIG. 3, a tapered or rounded surface 38 is formed on the lower side of each long projection 37 and each short projection 24. The tapered surfaces 38 relieve a fit-on resistance when the front retainer 30 is moved on the front end of the housing 10. An inclined guide surface 25 (see FIGS. 1, 6, and 7) is formed on each supporting wall 23A at a position forward from the stop 24A for guiding the male tab (not shown).

Figure 4:
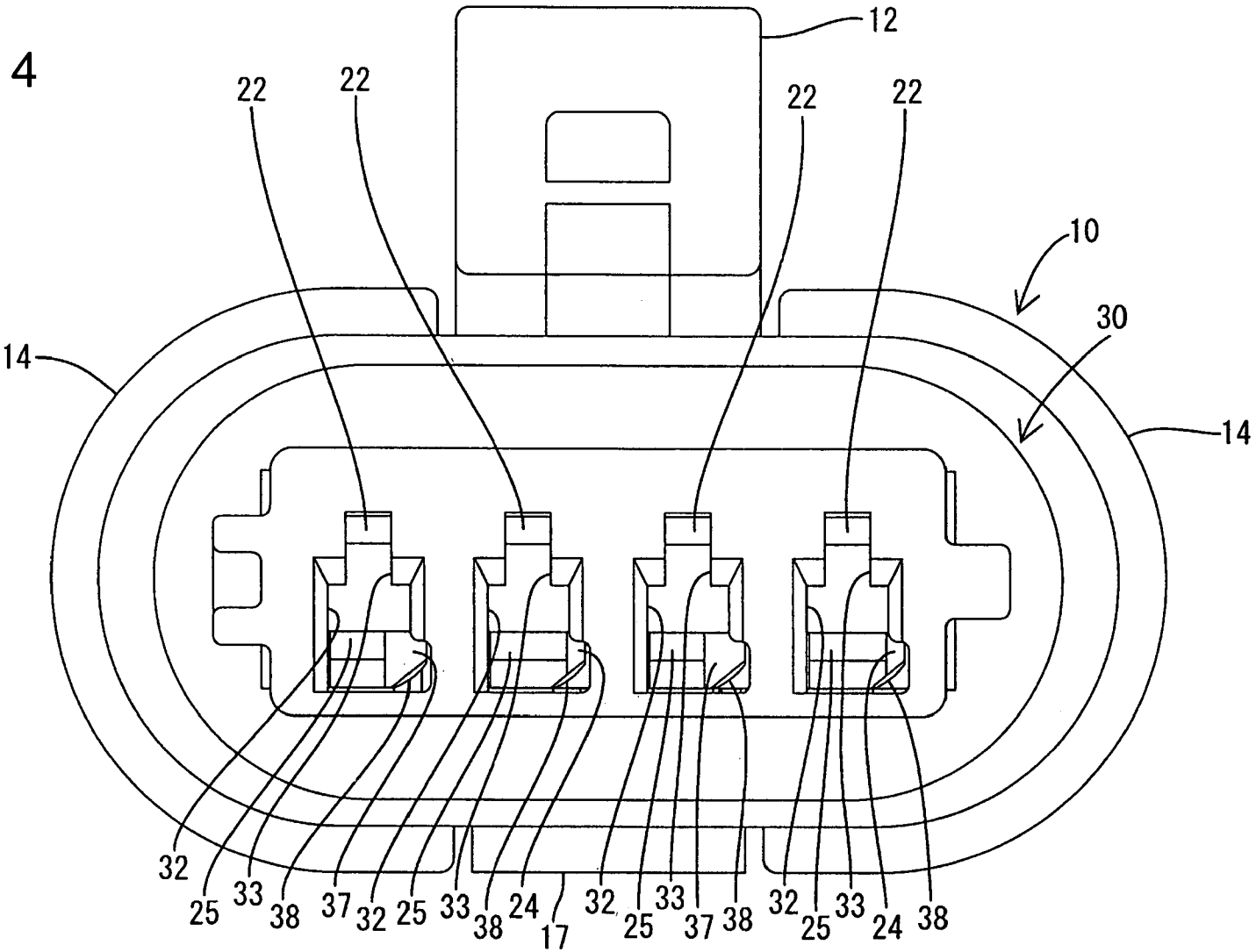
FIG. 4 is a front view showing the front retainer in a state after the front retainer is mounted on the connector housing.
Figure 5:
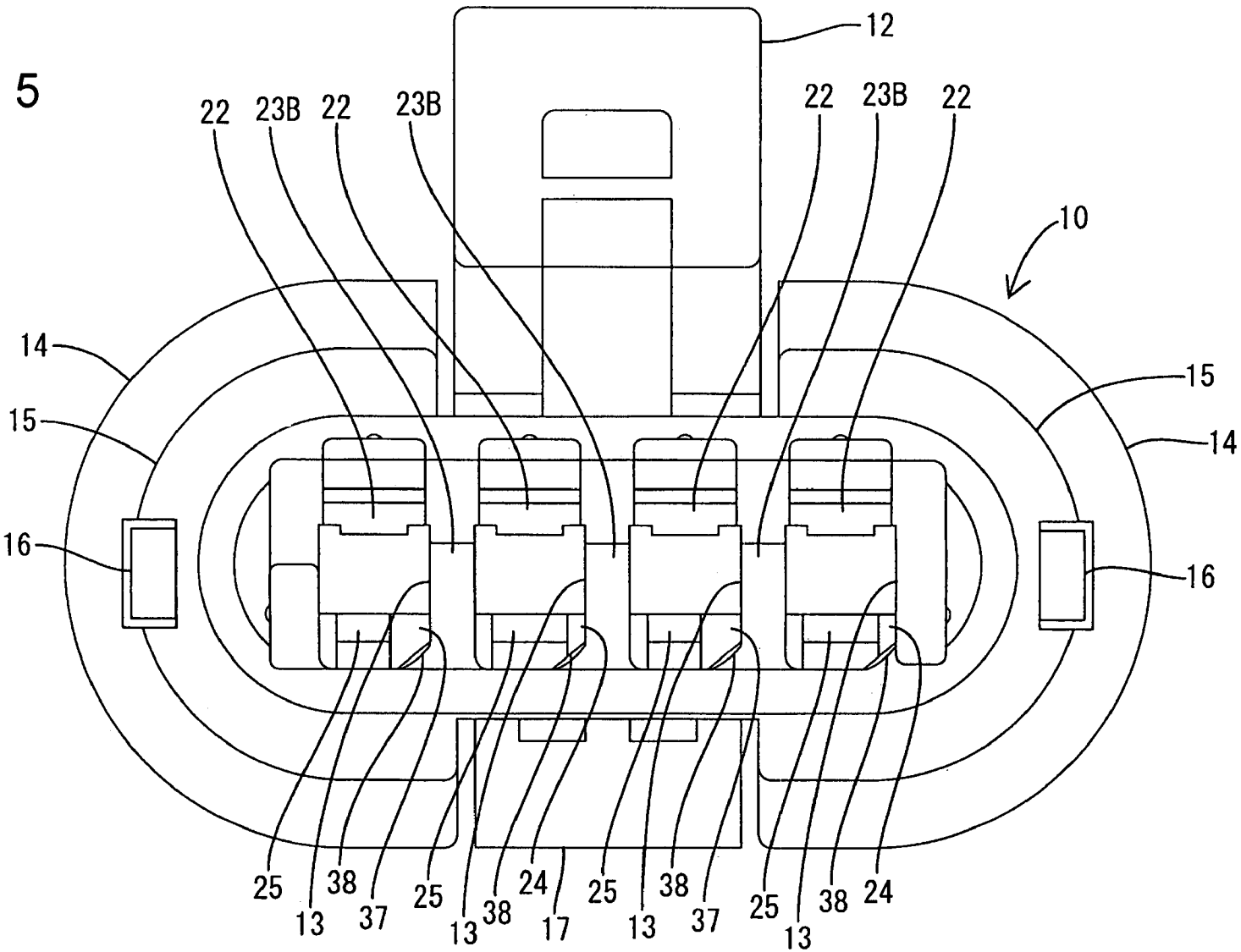
FIG. 5 is a front view showing the connector housing.
Figure 6:
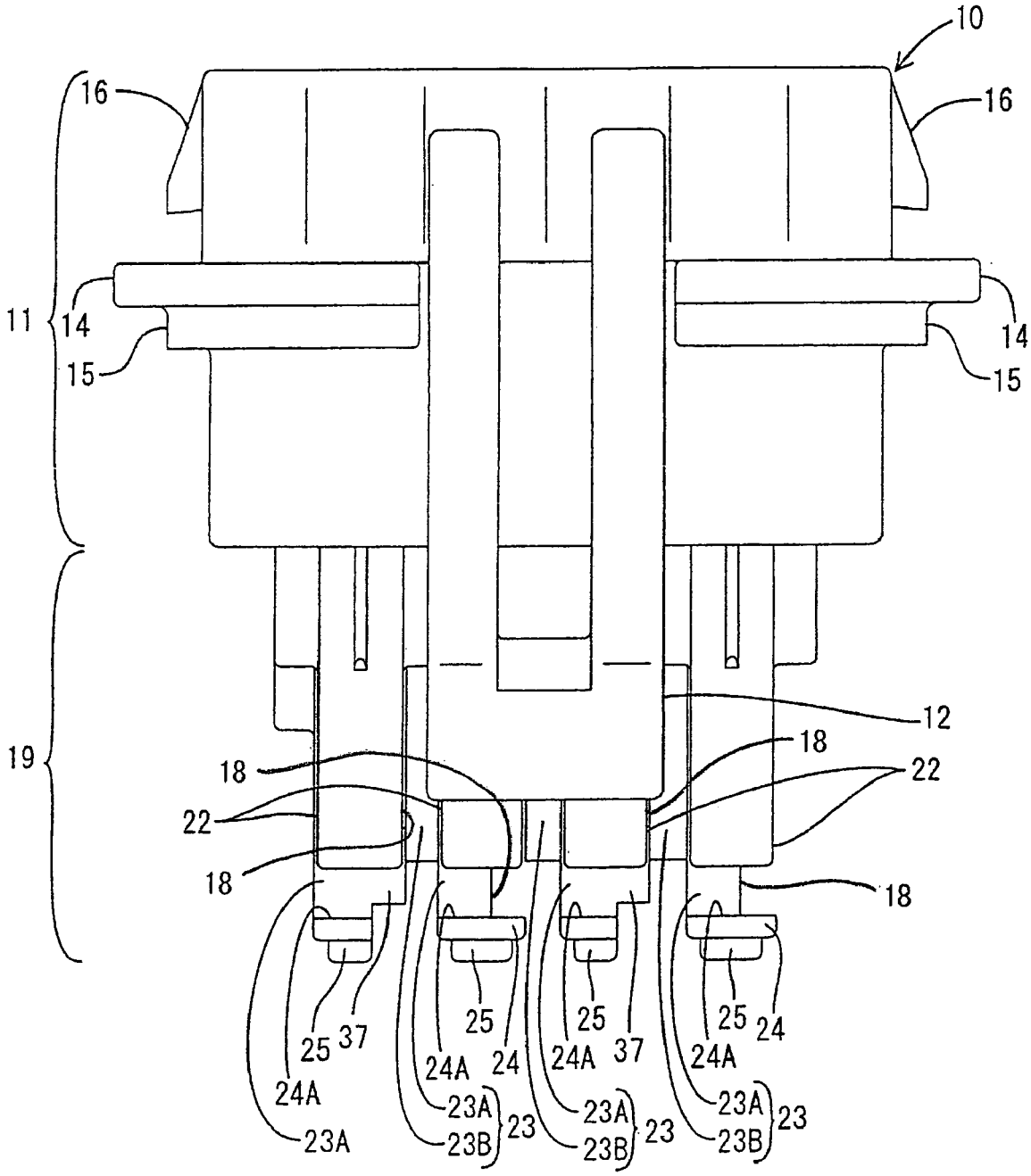
FIG. 6 is a plan view showing the connector housing.
Figure 7:
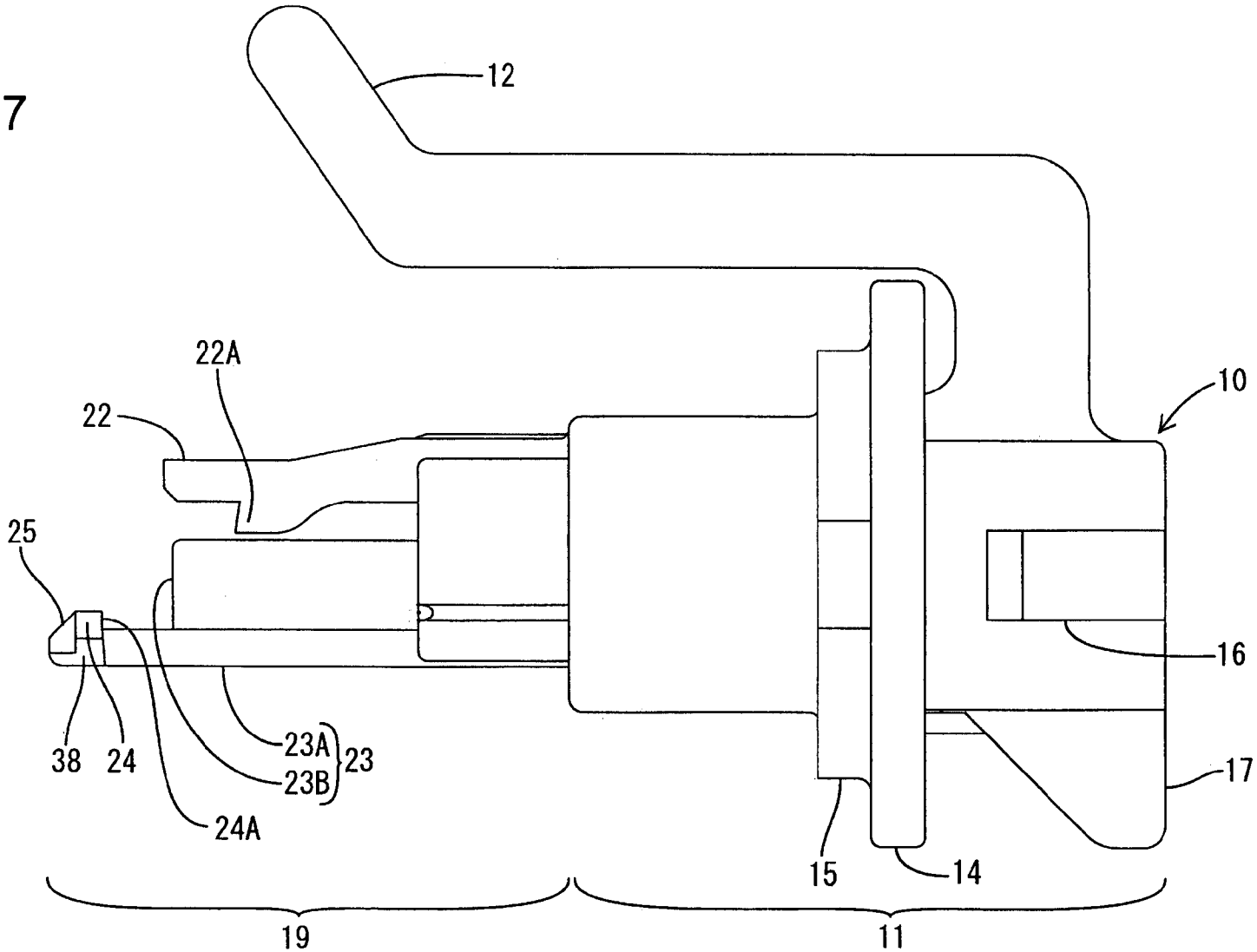
FIG. 7 is a side view showing the connector housing.
Figure 9:
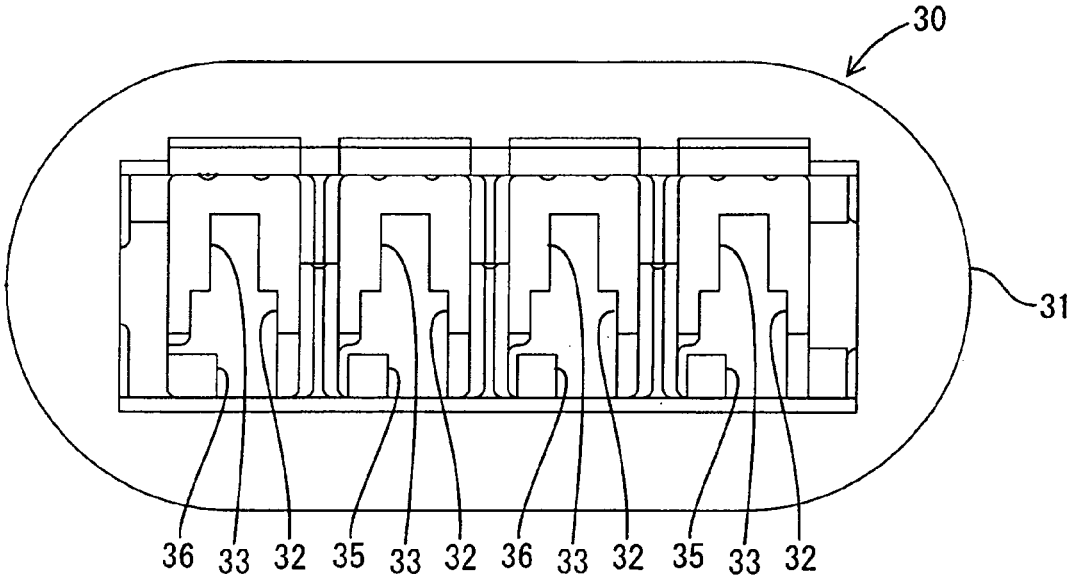
FIG. 9 is a rear view showing the front retainer.

The front retainer 30 is made of synthetic resin, and, as shown in FIGS. 4, 8, and 9, has the shape of a rearwardly open wide hood. The open rear end of the front retainer 30 can be mounted on the terminal-locking portion 19 and can be moved between a temporary locking position and a main locking position. The temporary locking position refers to the mounting position of the front retainer 30 where the terminal fittings 20 can be inserted into the respective cavities 13 and removed therefrom. At the temporary locking position, it is possible to perform an operation of unlocking the terminal fitting 20 from the lance 22. The main locking position refers to the mounting position of the front retainer 30 where the terminal fitting 20 is prevented from slipping out of the cavity 13. At the main locking position, the front retainer 30 is pressed down against the lance 22 to prevent the lance 22 from elastically deforming. Thus, it is impossible to perform an operation of unlocking the terminal fitting 20 from the lance 22.

Figure 10:
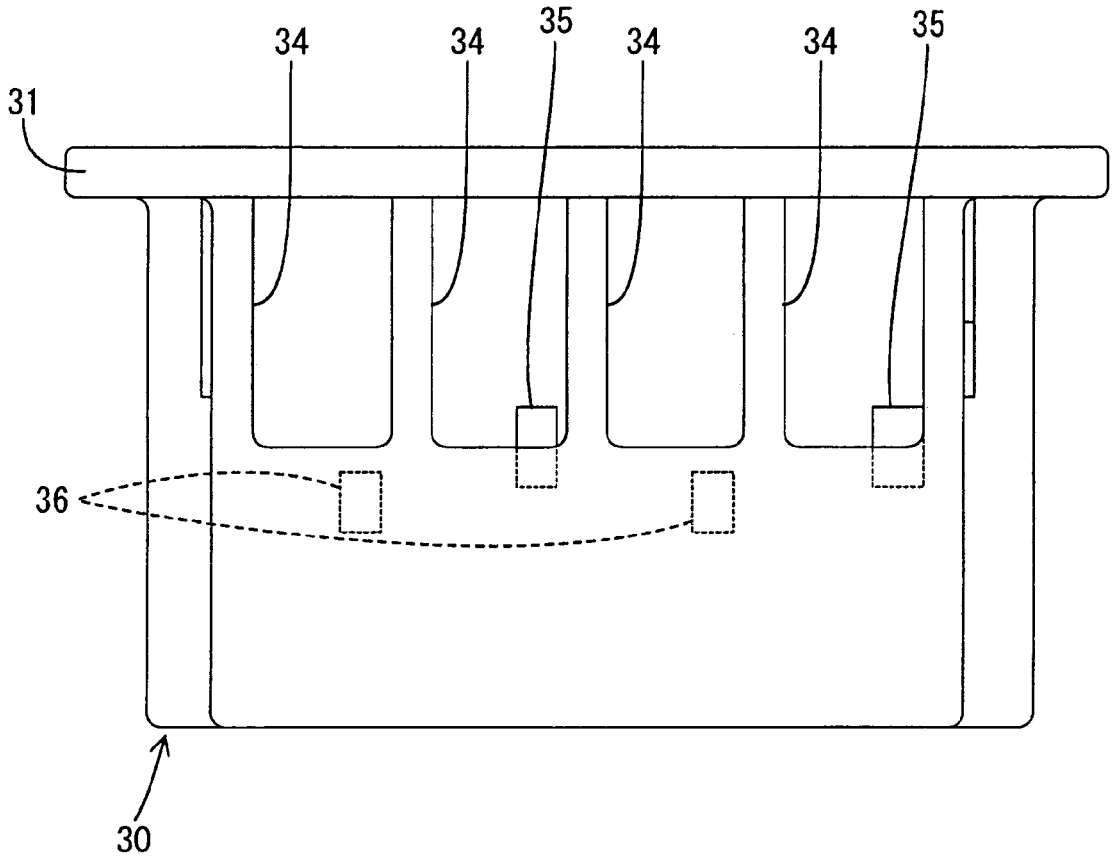
FIG. 10 is a plan view showing the front retainer.

As shown in FIG. 10, four windows 34 are formed approximately in a rear half of an upper wall of the front retainer 30, and hence closer to the open rear end of the retainer 30. The front end of each window 34 is forward from the front end of the lance 22 and the rear end of each window 34 is almost aligned longitudinally with the support of the lance 22 when the front retainer 30 is at the temporary locking position. Thus, the lances 22 can flex into the windows 34 when the front retainer 30 is at the temporary locking position. A hold down portion 31 projects out from around the periphery of a rear end of the front retainer 30, which is the end of the front retainer 30 that fits on the front end of the housing 10. The hold-down portion 31 holds down a front surface of the rubber plug and the inner periphery of the hold-down portion 31 helps to hold the terminal fitting 20 at the predetermined position. Tab insertion openings 32 (see FIGS. 4, 8, and 9) are formed through a front wall of the front retainer 30 and align with the position of the cavities 13 to receive the male tabs. Jig insertion openings 33 (see FIGS. 4, 8, and 9) also are formed on the front wall of the front retainer 30 and can receive an unlocking jig (not shown) inserted from the front of the front retainer 30 to perform an operation of unlocking the lance 22 from the terminal fitting 20.

As shown with broken lines of FIG. 10, rear and front locking projections 35, 36 are arranged at longitudinal central portions of an inner surface of the front retainer 30 opposite to the surface that has the windows 34. The locking projections 35, 36 are in transverse positions corresponding to the guide slits 18. The front locking projections 35 are disposed at longitudinal positions closer to the front end of the front retainer and are in transverse positions corresponding to the long projections 37. The rear locking projections 36 are in transverse positions corresponding to the short projections 24. The rear end of each rear locking projection 35 is inclined so that the rear locking projection 35 rides easily across the short projection 24. However, the front end of each rear locking projection 35 is erect to prevent the front retainer 30 from moving in an unlocking direction. On the other hand, the front locking projection 36 is erect at its front and rear ends to prevent the front retainer 30 from moving accidentally from the temporary locking position to the main locking position.

The width of each of the locking projections 35, 36 is set so that they fit in the guide slits 18. The locking projections 35, 36 are capable of entering the guide slits 18 when the front retainer 30 is at the temporary locking position and the main locking position and are capable of moving along the guide slits 18, when the front retainer 30 moves from the temporary locking position to the main locking position.

The front retainer 30 initially is fit on the housing 10 from the front and is mounted at the temporary locking position inside the housing 10. At this time, the rear locking projections 35 contact front surfaces of the short projections 24. The rear side of the front locking projection 35 is inclined. Thus, the front retainer 30 deforms elastically so that the rear locking projection 35 can ride over the tapered surface 38 of the short projection 24. Accordingly, the front retainer 30 moves smoothly to the temporary locking position without generating a high fit-on resistance. The front retainer 30 returns elastically to its original state upon reaching the temporary locking position. As a result, the rear locking projection 35 enters the guide slit 18 and is locked to a rear surface of the short projection 24. Thus the front retainer 30 is prevented from being unlocked and separated. At this time, the front locking projection 36 abuts to the pressing prevention surface 37A of the long projection 37. Thus the front retainer 30 is prevented from moving accidentally from the temporary locking position to the main locking position.

The terminal fittings 20 then are inserted into the cavities 13 from the rear end of the housing 10. More particularly, the stabilizers 21 enter the guide slits 18 to guide the terminal fittings 20 to the predetermined normal mounting position. When the terminal fitting 20 reaches the predetermined normal mounting position, the front end of the terminal fitting 20 contacts the stop 24A disposed at the front end of the support 23. Thus, the terminal fitting 20 is stopped at the predetermined front position. At the same time, the locking claw 22A of the lance 22 penetrates into the lance hole 28 of the terminal fitting 20 to lock the terminal fitting 20 thereto. Thus, the terminal fitting 20 will not slip off rearward.

The front retainer 30 then is pushed rearwardly from the temporary locking position to the main locking position. More particularly, an operational force that exceeds the fit-on resistance is applied to the front retainer 30. As a result, the front retainer deforms elastically a sufficient amount to relieve the fit-on resistance and the front locking projection 36 rides over the tapered surface 38 of the long projection 37. Accordingly, the front retainer 30 is moved towards the main locking position, and this movement is guided as the rear locking projection 35 slides along the guide slit 18. The front locking projection 36 aligns with the guide slit 18 when the front retainer 30 reaches the main locking position. As a result, the front retainer 30 elastically returns to its original state, and the front locking projection 36 locks to the rear surface of the long projection 37. Thus, the front retainer 30 is held and cannot slip off the housing 10.

As described above, the locking edges defined by the short projections 24 and the long projections 37 for locking the front retainer 30 to the housing 10 are formed on the guide slits 18 that guide the stabilizers 21. Thus, the connector has a simpler construction than the conventional connector in which the guide slit and the locking edge are formed separately. Further the lance 22 is part of the outer wall of the housing 10, and the flexing of the lance 22 is performed outside the housing 10. Therefore the connector has a simpler construction than the conventional connector in which the flexible space of the lance is inside the housing.

Hence, the above-described construction contributes to the miniaturization of the connector. Furthermore the longitudinal positions of the locking projections 35 and 36 are shifted from each other, and the temporary locking position and the main locking position are set. Therefore it is possible to ship the connector by mounting the front retainer 30 on the housing 10 at the temporary locking position. That is, the above-described construction improves the workability in assembling the connector.

The invention is not limited to the embodiment described above and illustrated in the drawings. For example, the following embodiments are included in the technical scope of the invention. Further, modifications of the embodiments can be made without departing from the spirit and scope of the invention.

The front retainer is exemplified as the mounting member to be mounted on the front of the housing. However, a front mask with no retaining function but only a function of stopping the terminal fitting at the predetermined front position may be mounted on the front of the housing.

The projection is exemplified as the locking portion of the front retainer. However, a concave member can be used alternatively, provided that it can lock the mounting member to the locking edge of the housing.

The locking projections serve both as the temporary locking projection and the main locking projection. However, the temporary locking projection and the main locking projection may be formed separately.

What is claimed is:

1. A connector, comprising: terminal fittings each having a stabilizer projecting therefrom; a housing having opposite front and rear ends and cavities extending through the housing from the front end to the rear end for receiving the terminal fittings; and a mounting member which is mounted on the front end of said housing, wherein said housing has guides formed therein for receiving and guiding the stabilizer when the terminal fittings are inserted into the respective cavities; and said mounting member being mountable on said housing by locking said mounting member to said guides and wherein said guides are grooves formed in an outer surface of the housing and communicating with an inside of the respective cavity, said guides extending in a longitudinal direction along an insertion direction of said terminal fittings; a locking edge being formed at a front end of each of said guides and being aligned to intersect the longitudinal direction of the respective guide; the mounting member being formed with locks that are locked to said locking edge for preventing said mounting member from slipping off from said housing.

2. The connector of claim 1, wherein the housing has resiliently deformable lances disposed respectively in said cavities and configured for locking the terminal fittings in the cavities, an outer surface of each of said lances defining a part of an outer surface of said housing, each of said lances being elastically deformable to project outward from said housing.

3. The connector of claim 2, wherein said mounting member is a front retainer defining a cap shape, said front retainer being configured for penetrating into flexible regions of said lances and preventing said lances from deforming in a direction in which said terminal fitting is unlocked from said lance.

4. The connector of claim 3, wherein the cavities are arranged side-by-side in said housing.

5. The connector of claim 3, wherein said locking edges of said guides include at least one temporary locking edge and at least one main locking edge offset from said temporary locking edge in a longitudinal direction of said housing.

6. The connector of claim 5, further comprising at least one temporary locking projection and at least one main locking projection formed on said front retainer at transverse positions for engaging the respective guides, said temporary locking projection and said main locking projection being at different respective longitudinal positions on said front retainer.

7. The connector of claim 6, wherein said temporary locking projection is engageable with said temporary locking edge to hold said front retainer at a temporary locking position on said housing, and wherein said main locking projection is engageable with said main locking edge to hold said front retainer at a main locking position on said housing.

8. The connector of claim 7, wherein the front retainer is configured to permit an elastic deformation of said lance when said front retainer is at the temporary locking position so that said terminal fittings can be inserted into said cavities and removed therefrom.

9. The connector of claim 8, wherein the front retainer is configured to prevent elastic deformation of said lance when said front retainer is at the main locking position for locking said terminal fittings in said cavities.

10. A connector, comprising:

a housing having opposite front and rear ends and cavities extending through the housing from the rear end to the front end, guide slits extending along the respective cavities from the rear end of the housing towards the front end of the housing, rearwardly facing locking edges at front ends of the respective guide slits and being open to an outer surface of the housing;

terminal fittings mountable respectively in the cavities, each of said terminal fittings having a stabilizer slidably receivable in the guide slit of the respective cavity; and a mounting member mounted on the front end of said housing and having locks engageable respectively with the locking edges of the guide slits for holding the mounting member on the housing.

11. The connector of claim 10, wherein the locking edges comprise at least one temporary locking edge and at least one main locking edge more rearward than the temporary locking edge, the locks of the mounting member comprising at least one temporary lock and at least one main lock engageable respectively with the temporary locking edge and the main locking edge for holding the mounting member selectively at a temporary locking position or at a main locking position on the housing.

12. The connector of claim 11, wherein housing further comprises resiliently deflectable lances projecting into the respective cavities for locking the terminal fittings, and wherein said mounting member is a retainer configured to permit said locks to deflect when the retainer is at the temporary locking position and configured to prevent the locks from deflecting when the retainer is at the main locking position.

13. The connector of claim 12, wherein said temporary locking projection and said main locking projection are at different respective longitudinal positions on said retainer.

14. The connector of claim 12, wherein each of said lances has an outer surface defining a part of the outer surface of said housing, each of said lances being elastically deformable to project outward from portions of said housing adjacent the lance.

* * * * *